US006029984A

United States Patent [19]

Pivotto

[11] Patent Number: 6,029,984

[45] Date of Patent: Feb. 29, 2000

[54] SPRUNG SKATE WITH ALIGNED WHEELS

[76] Inventor: Elia Giovanni Pivotto, Strada Serra della Boldrina 1, 15040 Pecetto Di Valenza (AL), Italy

[21] Appl. No.: 08/887,820

[22] Filed: Jul. 3, 1997

[30] Foreign Application Priority Data

Jul. 3, 1996 [IT] Italy ..... AL96U0008

[51] Int. Cl.[7] ..... A63C 17/02

[52] U.S. Cl. ..... 280/11.28; 280/11.22

[58] Field of Search ..... 280/11.14, 629, 280/87.042, 11.22, 11.27, 11.28; 301/5.3, 5.7; 36/118.5

[56] References Cited

U.S. PATENT DOCUMENTS

| | | | |
|---|---|---|---|
| 3,348,855 | 10/1967 | Marker | 280/629 |
| 4,061,348 | 12/1977 | Carter | 280/11.14 |
| 4,272,090 | 6/1981 | Wheat | 280/11.22 |
| 4,709,491 | 12/1987 | Morell et al. | 36/118.5 |
| 5,135,244 | 8/1992 | Allison | 280/11.22 |
| 5,486,011 | 1/1996 | Nelson | 280/11.22 |
| 5,536,025 | 7/1996 | Landay | 280/11.22 |
| 5,582,418 | 12/1996 | Closser | 280/11.22 |
| 5,630,598 | 5/1997 | Zorzi et al. | 280/11.22 |
| 5,690,344 | 11/1997 | Chen | 280/11.22 |

FOREIGN PATENT DOCUMENTS

| | | | |
|---|---|---|---|
| 154922 | 6/1938 | Austria | 280/11.22 |
| 488318 | 11/1952 | Canada | 280/11.22 |
| 812169 | 8/1951 | Germany | 280/11.22 |
| 2308173 | 8/1974 | Germany | 301/5.3 |
| 1402028 | 8/1975 | United Kingdom | 280/11.22 |

*Primary Examiner*—J. J. Swann
*Assistant Examiner*—Frank Vanaman
*Attorney, Agent, or Firm*—Helfgott & Karas, P.C.

[57] ABSTRACT

A skate with aligned wheels substantially comprising: a plurality of wheels; and a support member including on one side a bearing base to unmovably support a shoe and to contain the wheels on the other side; and travelling stabilizing means that cooperate and are connected to the support member and to a pair of wheels. Skate vibration dampening is guaranteed by the cooperation between stabilizing means and support member through resilient means; moreover, the stabilizing means are connected to support member and wheels in order to allow each one of the rotation axes of the wheels to be moved, whether separately or not with respect to the other rotation axes, vertically with respect to the ground.

18 Claims, 3 Drawing Sheets

SPRUNG SKATE WITH ALIGNED WHEELS

BACKGROUND OF THE INVENTION

The present invention refers to a skate with aligned wheels with a particular springing arrangement inserted between wheel rotation axis and carrier frame.

Skates with aligned wheels are nowadays the vast majority of roller skates being widely present on the market, and are used, above all but not exclusively, by young skaters that with them skate on any type of road surface, and therefore meet the most different obstacles and unevennesses in contact with the different types of grounds. The impact of the skate wheels with the ground therefore creates strong vibrations and, at times, high jerks that can generate falls, sometimes also with severe consequences.

The skates that are nowadays present on the market, though being equipped with various arrangements that allow obtaining optimum levels as regards streamline, braking, etc., are not equipped with devices suitable to effectively dampen such vibrations, jerks or impacts.

BRIEF SUMMARY OF THE INVENTION

Object of the present invention is providing skates with aligned wheels equipped with a device that, though maintaining the skate's dynamic features, removes or highly reduces problems deriving from impacts with the ground. The arrangement of the present invention allows keeping the skate directionality, allowing the wheel rotation axes to vertically and/or horizontally move with respect to the ground, and ensures the simultaneous springing and rolling of the wheels themselves. Moreover, the arrangement of the present invention allows adjusting the dampening degree of the above vibrations taking into account various factors such as: skater weight, ground surface, thrust energy, skater skill, sliding softness.

The above and other objects and characteristics of the present invention are obtained by means of the skate with aligned wheels and now trivial embodiments of the present invention.

BRIEF DESCRIPTION OF THE SEVERAL VIEWS OF THE DRAWING

The present invention will be described in more detail with reference to the following description, carried out in conjunction with the enclosed drawings, in which.

DETAILED DESCRIPTION OF THE INVENTION

Figure 1:
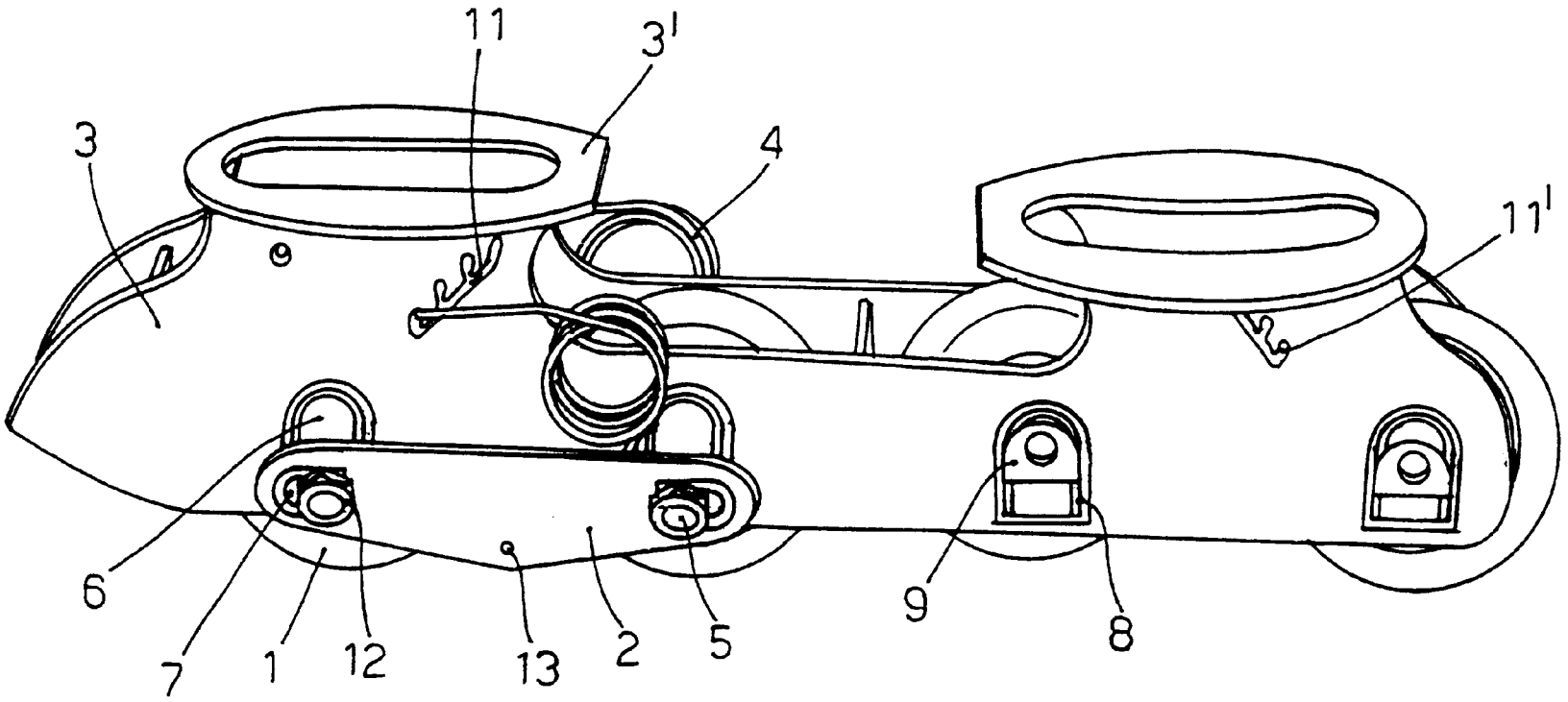
FIG. 1 is a side perspective view that shows a first preferred embodiment of the skate with aligned wheels of the present invention.

With reference first to FIG. 1, a first preferred embodiment of the skate with aligned wheels of the present invention is shown, this skate substantially comprising a plurality of wheels 1 (that are usually four, but that in some skates can be more), and a support member 3; the support member is substantially bracket-shaped suitable to contain therein the wheels 1, and includes on a first side a resting base 3' for the support of a plane (not shown, because its configuration is well-known) on which there will rest and be secured a shoe or a foot-housing arrangement, both of them being also of a known configuration and therefore not being shown. Obviously, the wheels 1 will be rotatingly secured and housed within the support member 3 on the opposite side to the foot-resting arrangement.

The springing and vibration-dampening characteristics with simultaneous maintenance of the skate directionality of the present invention are realized by means of travelling stabilizing means 2, that in this case are composed of elongated bars 2 that are slightly triangularly shaped. These stabilizing bars 2 cooperate and are connected each one with the support member 3 and with a pair of wheels 1: in practice, in the embodiment in FIG. 1, two stabilizing bars 2 are present on each side, each one connected to two following wheels 1. The stabilizing bars 2, in order to allow springing the skate, swingingly cooperate with the support member 3 through resilient means (like the springs 4 in FIG. 1) located between and connected to support member 3 and stabilizing bars 2. This configuration allows each one of the rotation axes of the wheels 1 to move, separately with respect to the others, vertically with respect to the ground.

The springs 4, as can be seen in FIG. 1, are assembled in opposed pairs, and are hooked on one end of the stabilizing bars 2 into a small hole 13, while they are hooked at the other end to the support member 3 by means of slits 11 equipped with toothings 11' adapted to allow adjusting position and force of the springs 4 depending on the chosen toothing 11' when hooking.

Figure 2:
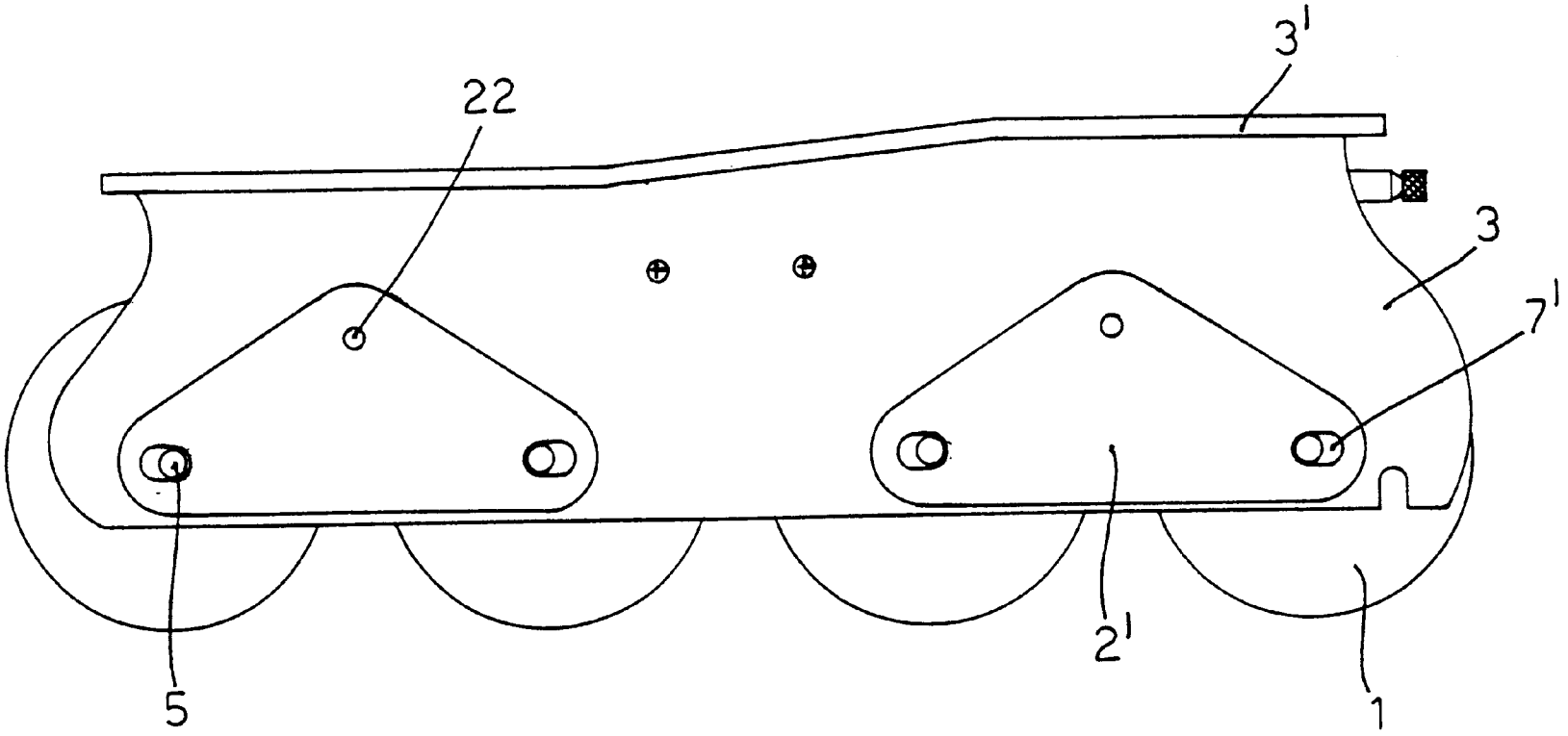
FIG. 2 is a side view showing a second preferred embodiment of the skate with aligned wheels of the present invention.
Figure 4:
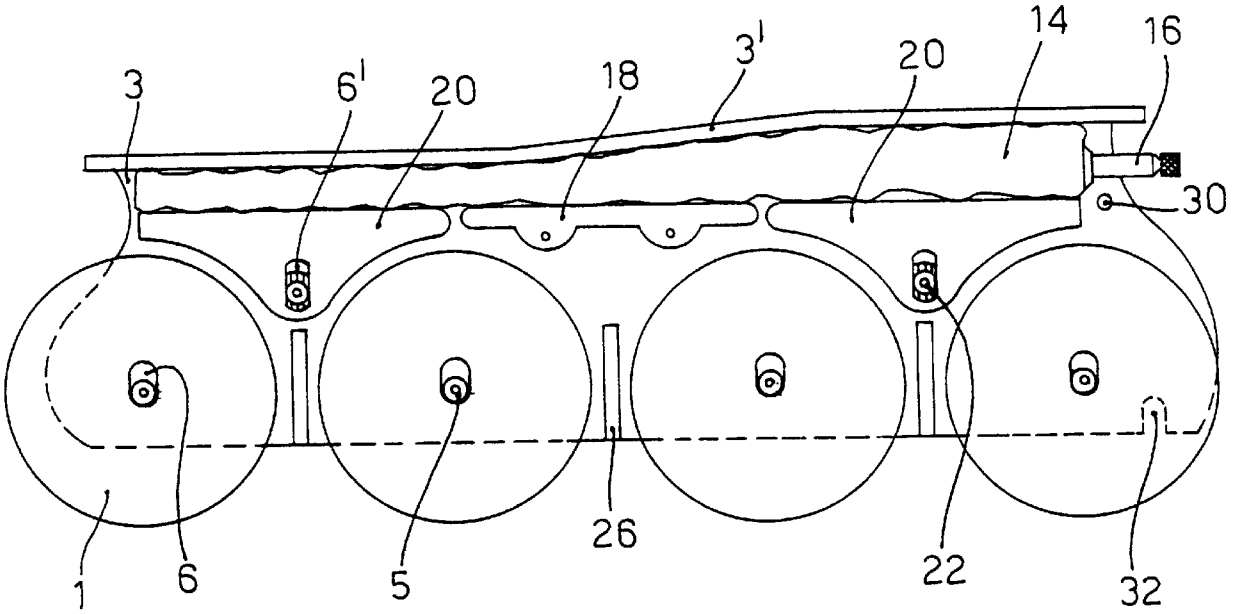
FIG. 4 is a front, partially sectioned view performed along line IV—IV in FIG. 3.
Figure 3:
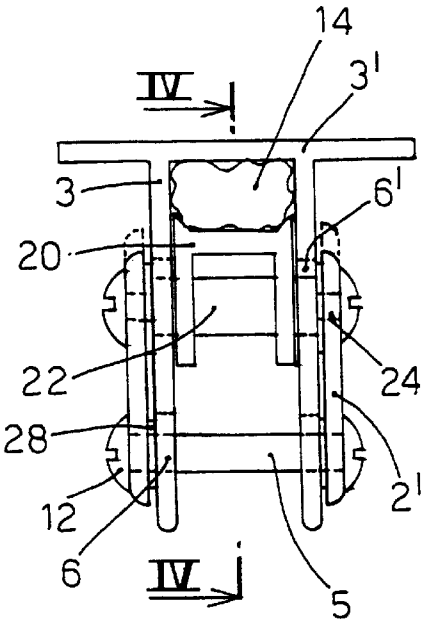
FIG. 3 is a front view of the skate in FIG. 2 without the wheels.

Obviously other arrangements are possible if suitable to guarantee the skate springing through adequate choices of the resilient means 4; a possible solution is shown for the second preferred embodiment in FIGS. 2 to 4, wherein the resilient means are composed of a pre-inflated or inflatable cushion 14 suitable to be filled with a fluid, air- or gas-type, through for example a valve or an inflating spout 16. The pre-inflated or inflatable cushion 14 is inserted inside the support member 3 and is resting on a fixed bearing 18 and a pair of sliding bearings 20, one for each pair of wheels. The pre-inflated or inflatable cushion 14 could also be divided into a plurality of parts, always supported by bearings 18 and 20. Moreover, any other resilient means could be provided, for example a sort of "filled" cushion or planar composed of suitable resilient material, such as rubber, sponge rubber, etc.

Then, in order to allow vertically moving the rotation axes of the wheels 1, the support member 3 is equipped with a plurality of vertically-elongated holes 6, that will house the rotation pins 5 of the wheels 1.

To make the vertical sliding of the pins 5 easier inside the vertically-elongated holes 6, each one of such holes 6 is equipped, according to a possible constructive arrangement, with track guides 8 on its own internal perimeter. The pins 5 in the wheels 1, in turn, are inserted into respective plaques 9, and each one of the plaques 9 is so shaped as to be able to slide onto the corresponding track 8 of the vertically-elongated holes 6.

Finally, in order to allow the vertical and separated displacement of the rotation axes of the wheels 1, the stabilizing bars 2 are equipped at both their ends with horizontally-elongated holes 7: purpose of such holes 7 is providing a backlash for example when one of the wheels of a pair is lifted when it passes over a ground projection, while the other wheel remains at ground level. Each one of the horizontally-elongated holes 7 receives a corresponding one of the rotation pins 5 of the wheels 1, after having inserted the rotation pins and having made the rotation pins go out of the vertically-elongated holes 6; the skate is completed by blocking every pin 5 going out of the horizontal holes 7 of the bars 2 through common locking means 12, like nuts, hexagonal-headed bolts, etc.

With reference now to FIGS. 2 to 4, a second preferred embodiment of the skate with aligned wheels of the present invention is shown, wherein parts that are the same or identical to those shown in FIG. 1 keep the same reference numbers.

In this second preferred embodiment, the skate of the present invention has its support member 3 so shaped as to have, in addition to sets of two vertically-elongated holes 6 quite similar to the one of the support member 3 in FIG. 1 (that is, four sets of vertically-elongated holes 6 as also shown in FIG. 2), suitable to contain the rotation pins 5 of the wheels 1, also two vertically-elongated holes 6' for every pair of wheels 1. Obviously, these vertically-elongated holes 6' are obtained on both sides of the support member 3 and are placed, as can be clearly seen in FIG. 2, in a central and upper position with respect to the respective pairs of vertically-elongated holes 6. These vertically-elongated holes 6', as will be described below, are adapted to contain pins 22 to secure the support member 3 to stabilizing means 2' for this embodiment. Through such securing action, the stabilizing means 2' will be able to vertically move with respect to the ground through the displacement of the pins 22 into the elongated holes 6'.

These stabilizing means 2' are composed of tongues 2' that are substantially triangularly shaped: the tongues 2' are equipped on one of their vertexes with a hole 24 adapted to contain the pin 22 that can be inserted in the vertically-elongated holes 6', while they are equipped in the other two vertexes thereof with two horizontally-elongated holes 7'. To completely build up the skate, the rotation pins 5 of the wheels 1 are inserted first into the corresponding vertically-elongated holes 6 of the support member 3 and then into the corresponding horizontally-elongated holes 7' of the tongues 2', and then these pins 5 are blocked through the common locking means 12 already mentioned before.

The second embodiment of the skate of the present invention provides the previously-described resilient means 14, in addition to a set of construction parts, like: the spacers 26 between the wheels 1; a plurality of teflon washers 28 for support between support member 3 and tongues 2'; a hole 30 to secure, and a housing 32 to abut a braking device (not shown).

Obviously, numerous variations to the arrangements of the present invention can be carried out, both when realizing the resilient means 4, 14 or the stabilizing means 2, 2', and when prearranging all possible vertical displacement combinations for the rotation axes of the wheels 1. In fact, as an average skilled person in the art can easily appreciate, it is possible to remove the separate movement of the rotation axes of the wheels 1 by not creating the horizontally-elongated holes 7, 7' in the stabilizing means 2, 2', and obtaining therein simple circular holes whose diameter is greater than pin 5; and it is possible to also remove the vertical movement of the rotation axes of the wheels 1 by replacing the vertically-elongated holes 6, 6' (or some of them) with simple circular holes, being of such greater diameter than pin 5 as higher the flexibility to be obtained. All these variations being well within the range of an average skilled person in the art when taking into account the teachings of the present description, the scope of the present invention must be intended as limited only by the following claims.

Although the present invention has been described with reference to preferred embodiments, numerous modifications and rearrangements can be made and still the result will come within the scope of the invention.

What is claimed is:

1. Skate with aligned wheels substantially comprising:

a plurality of wheels;

a support member including on a first side a bearing base to unmovably support a shoe and suitable to contain said wheels on a side opposite to the first side; and stabilizing means, said stabilizing means cooperating and being connected to said support member and to a pair of said wheels, said stabilizing means swingingly cooperating with said support member through resilient means, said stabilizing means being connected to said support member and to said wheels in order to allow a rotation axis of each one of said wheels to be moved, separately with respect to another rotation axis of another one of said wheels, vertically with respect to a ground, wherein said resilient means comprise springs assembled in opposed pairs, said springs being hooked to said stabilizing means into a small hole and being hooked to said support member through slits equipped with toothings adapted to allow adjusting position and force of said springs.

2. Skate with aligned wheels substantially comprising:

a plurality of wheels;

a support member including on a first side a bearing base to unmovably support a shoe and suitable to contain said wheels on a side opposite to the first side; and stabilizing means, said stabilizing means cooperating and being connected to said support member and to a pair of said wheels, said stabilizing means swingingly cooperating with said support member through resilient means, said stabilizing means being connected to said support member and to said wheels in order to allow a rotation axis of each one of said wheels to be moved, separately with respect to another rotation axis of another one of said wheels, vertically with respect to a ground, wherein said resilient means are composed of a pre-inflated cushion adapted to be filled with a fluid, air-filled, said pre-inflated cushion being inserted inside said support member.

3. Skate with aligned wheels substantially comprising:

a plurality of wheels;

a support member including on a first side a bearing base to unmovably support a shoe and suitable to contain said wheels on a side opposite to the first side; and stabilizing means, said stabilizing means cooperating and being connected to said support member and to a pair of said wheels, said stabilizing means swingingly cooperating with said support member through resilient means, said stabilizing means being connected to said support member and to said wheels in order to allow a rotation axis of each one of said wheels to be moved, separately with respect to another rotation axis of another one of said wheels, vertically with respect to a ground, wherein said support member is equipped with a plurality of vertically-elongated holes, each one of said vertically-elongated holes being adapted to contain a rotation pin of said wheels.

4. Skate according to claim 3, wherein each one of said vertically-elongated holes is equipped with a plurality of track guides on an internal perimeter thereof, said pins of said wheels being inserted in respective plaques, each one of said plaques being so shaped as to slide onto a respective one of said plurality of track guides of said vertically-elongated holes.

5. Skate with aligned wheels substantially comprising:

a plurality of wheels;

a support member including on a first side a bearing base to unmovably support a shoe and suitable to contain said wheels on a side opposite to the first side; and stabilizing means, said stabilizing means cooperating and being connected to said support member and to a pair of said wheels, said stabilizing means swingingly cooperating with said support member through resilient means, said stabilizing means being connected to said support member and to said wheels in order to allow a rotation axis of each one of said wheels to be moved, separately with respect to another rotation axis of another one of said wheels, vertically with respect to a ground, wherein said stabilizing means are composed of elongated bars whose shape is slightly triangular and that are equipped at both ends thereof with horizontally-elongated holes, each one of said horizontally-elongated holes receiving a respective one of a plurality of rotation pins of said wheels going out of a plurality of vertically-elongated holes and allowing blocking of a respective one of said plurality of said rotation pins through locking means.

6. Skate with aligned wheels substantially comprising:

a plurality of wheels;

a support member including on a first side a bearing base to unmovably support a shoe and suitable to contain said wheels on a side opposite to the first side; and stabilizing means, said stabilizing means cooperating and being connected to said support member and to a pair of said wheels, said stabilizing means swingingly cooperating with said support member through resilient means, said stabilizing means being connected to said support member and to said wheels in order to allow a rotation axis of each one of said wheels to be moved, separately with respect to another rotation axis of another one of said wheels, vertically with respect to a ground, wherein said stabilizing means are composed of tongues whose shape is substantially triangular, said tongues being equipped on two vertexes thereof with at least a pair of horizontally-elongated holes, said support member being equipped with a plurality of vertically elongated holes, each one of said plurality of vertically-elongated holes being in a central and upper position with respect to each at least one pair of said horizontally elongated holes and the ground, said tongues being equipped on a third one of the vertexes thereof with a hole adapted to contain a pin that can be inserted into said plurality of vertically-elongated holes, a plurality of rotation pins of said wheels being inserted first into a respective one of said plurality of vertically-elongated holes of said support member and then into the corresponding horizontally-elongated holes of said tongues, said plurality of rotation pins being then blocked through locking means.

7. Skate with aligned wheels substantially comprising:

a plurality of wheels;

a support member including on a first side a bearing based to unmovably support a shoe and suitable to contain said wheels on a side opposite to the first side; and stabilizing means, said stabilizing means cooperating and being connected to said support member and to a pair of said wheels, said stabilizing means swingingly cooperating with said support member through resilient means, said stabilizing means being connected to said support member and to said wheels in order to allow a rotation axis of each one of said wheels to be moved vertically with respect to a ground wherein said resilient means comprise springs assembled in opposed pairs, said springs being hooked to said stabilizing means into a small hole and being hooked to said support member through slits equipped with toothings adapted to allow adjusting position and force of said springs.

8. Skate with aligned wheels substantially comprising:

a plurality of wheels;

a support member including on a first side a bearing base to unmovably support a shoe and suitable to contain said wheels on a side opposite to the first side; and stabilizing means, said stabilizing means cooperating and being connected to said support member and to a pair of said wheels, said stabilizing means swiningly cooperating with said support member through resilient means, said stabilizing means being connected to said support member and to said wheels in order to allow a rotation axis of each one of said wheels to be moved vertically with respect to a ground wherein said resilient means are composed of a pre-inflated cushion adapted to be filled with a fluid, air-filled, said pre-inflated cushion being inserted inside said support member.

9. Skate with aligned wheels substantially comprising:

a plurality of wheels;

a support member including on a first side a bearing base to unmovably support a shoe and suitable to contain said wheels on a side opposite to the first side; and stabilizing means, said stabilizing means cooperating and being connected to said support member and to a pair of said wheels, said stabilizing means swingingly cooperating with said support member through resilient means, said stabilizing means being connected to said support member and to said wheels in order to allow a rotation axis of each one of said wheels to be moved, vertically with respect to a ground, wherein said support member is equipped with a plurality of vertically-elongated holes, each one of said vertically-elongated holes being adapted to contain a rotation pin of said wheels.

10. Skate according to claim 9, wherein each one of said vertically-elongated holes is equipped with a plurality of track guides on an internal perimeter thereof, said pins of said wheels being inserted in respective plaques, each one of said plaques being so shaped as to slide onto a respective one of said plurality of track guides of said vertically-elongated holes.

11. Skate with aligned wheels substantially comprising:

a plurality of wheels;

a support member including on a first side a bearing base to unmovably support a shoe and suitable to contain said wheels on a side opposite to the first side; and stabilizing means, said stabilizing means cooperating and being connected to said support member and to a pair of said wheels, said stabilizing means swingingly cooperating with said support member through resilient means, said stabilizing means being connected to said support member and to said wheels in order to allow a rotation axis of each one of said wheels to be moved vertically with respect to a ground, wherein said stabilizing means are composed of elongated bars whose shape is slightly triangular and that are equipped at both ends thereof with circular holes, each one of said circular holes receiving a respective one of a plurality of rotation pins of said wheels going out of said support member equipped with a plurality of vertically-elongated holes and allowing blocking said corresponding one of said plurality of said rotation pins through locking means.

12. Skate with aligned wheels substantially comprising:

a plurality of wheels;

a support member including on a first side a bearing base to unmovably support a shoe and suitable to contain said wheels on a side opposite to the first side; and stabilizing means, said stabilizing means cooperating and being connected to said support member and to a pair of said wheels, said stabilizing means swingingly cooperating with said support member through resilient means, said stabilizing means being connected to said support member and to said wheels in order to allow a rotation axis of each one of said wheels to be moved vertically with respect to a ground, wherein said stabilizing means are composed of tongues whose shape is substantially triangular, said tongues being equipped on two vertexes thereof with a plurality of horizontally elongated holes, said support member being equipped with a plurality of vertically elongated holes, each one of said plurality of vertically-elongated holes being in a central and upper position with respect to each pair of said horizontally-elongated holes and the ground, said tongues being equipped on a third one of the vertexes thereof with a hole adapted to contain a pin that can be inserted into said plurality of vertically-elongated holes, a plurality of rotation pins of said wheels being inserted first into a respective one of said plurality of vertically-elongated holes of said support member and then into the corresponding horizontally enlongated holes of said tongues, said plurality of rotation pins being then blocked through locking means.

13. Skate with aligned wheels substantially comprising:

a plurality of wheels;

a support member including on a first side a bearing base to unmovably support a shoe and suitable to contain said wheels on a side opposite to the first side; and stabilizing means, said stabilizing means cooperating and being connected to said support member and to a pair of said wheels, said stabilizing means swingingly cooperating with said support member through resilient means, said stabilizing means being connected to said support member and to said wheels in order to allow a rotation axis of each one of said wheels to be moved, separately with respect to another rotation axis of another one of said wheels, vertically with respect to a ground, wherein said resilient means are composed of a pre-inflated cushion adapted to be filled with a fluid, gas-filled, said pre-inflated cushion being inserted inside said support member.

14. Skate with aligned wheels substantially comprising:

a plurality of wheels;

a support member including on a first side a bearing base to unimovably support a shoe and suitable to contain said wheels on a side opposite to the first side; and stabilizing means, said stabilizing means cooperating and being connected to said support member and to a pair of said wheels, said stabilizing means swingingly cooperating with said support member through resilient means, said stabilizing means being connected to said support member and to said wheels in order to allow a rotation axis of each one of said wheels to be moved, separately with respect to another rotation axis of another one of said wheels, vertically with respect to a ground wherein said resilient means are composed of an inflatable cushion adapted to be filled with a fluid, air filled, said inflatable cushion being inserted inside said support member.

15. Skate with aligned wheels substantially comprising:

a plurality of wheels;

a support member including on a first side a bearing base to unmovably support a shoe and suitable to contain said wheels on a side opposite to the first side; and stabilizing means, said stabilizing means cooperating and being connected to said support member and to a pair of said wheels, said stabilizing means swiningly cooperating with said support member through resilient means, said stabilizing means being connected to said support member and to said wheels in order to allow a rotation axis of each one of said wheels to be moved, separately with respect to another rotation axis of another one of said wheels, vertically with respect to a ground, wherein said resilient means are composed of an inflatable cushion adapted to be filled with a fluid, gas-filled, said inflatable cushion being inserted inside said support member.

16. Skate with aligned wheels substantially comprising:

a plurality of wheels;

a support member including on a first side a bearing based to unmovably support a shoe and suitable to contain said wheels on a side opposite to the first side; and stabilizing means, said stabilizing means cooperating and being connected to said support member and to a pair of said wheels, said stabilizing means swingingly cooperating with said support member through resilient means, said stabilizing means being connected to said support member and to said wheels in order to allow a rotation axis of each one of said wheels to be moved vertically with respect to a ground, wherein said resilient means are composed of a pre-inflated cushion adapted to be filled with a fluid, gas-filled, said pre-inflated cushion being inserted inside said support member.

17. Skate with aligned wheels substantially comprising:

a plurality of wheels;

a support member including on a first side a bearing based to unmovably support a shoe and suitable to contain said wheels on a side opposite to the first side; and stabilizing means, said stabilizing means cooperating and being connected to said support member and to a pair of said wheels, said stabilizing means swingingly cooperating with said support member through resilient means, said stabilizing means being connected to said support member and to said wheels in order to allow a rotation axis of each one of said wheels to be moved vertically with respect to a ground wherein said resilient means are composed of an inflatable cushion adapted to be filled with a fluid, air-filled, said inflatable cushion being inserted inside said support member.

18. Skate with aligned wheels substantially comprising:

a plurality of wheels;

a support member including on a first side a bearing based to unmovably support a shoe and suitable to contain said wheels on a side opposite to the first side; and stabilizing means, said stabilizing means cooperating and being connected to said support member and to a pair of said wheels, said stabilizing means swingingly cooperating with said support member through resilient means, said stabilizing means being connected to said support member and to said wheels in order to allow a rotation axis of each one of said wheels to be moved vertically with respect to a ground wherein said resilient means are composed of an inflatable cushion adapted to be filled with a fluid, gas filled, said inflatable cushion being inserted inside said support member.

* * * * *